US005875708A

United States Patent [19]

Bielfeldt

[11] Patent Number: 5,875,708

[45] Date of Patent: Mar. 2, 1999

[54] METHOD OF CONTROLLING PRESS FORCE IN A CONTINUOUSLY OPERATING PRESS

[75] Inventor: Friedrich B. Bielfeldt, Paehl, Germany

[73] Assignee: Machinenfabrik J. Dieffenbacher GmbH & Co., Eppingen, Germany

[21] Appl. No.: 867,647

[22] Filed: Jun. 2, 1997

[30] Foreign Application Priority Data

Jun. 3, 1996 [DE] Germany ..... 1 9622197.8

[51] Int. Cl.[6] ..... B30B 15/34; B30B 5/06

[52] U.S. Cl. ..... 100/38; 100/41; 100/154; 100/311

[58] Field of Search ..... 100/38, 41, 154, 100/311, 101, 103

[56] References Cited

U.S. PATENT DOCUMENTS 4,718,843 1/1988 Carlsson et al. ..... 100/311

5,112,209 5/1992 Ahrweiler et al. ..... 100/311

5,404,810 4/1995 Bielfeldt ..... 100/311

5,562,028 10/1996 Bielfeldt et al. ..... 100/311

*Primary Examiner*—Stephen F. Gerrity

*Attorney, Agent, or Firm*—Foley & Lardner

[57] ABSTRACT

A method of controlling the press force on at least one press heating plate along the press length of an operating cycle. For a reduction of specific press force from a maximum press force towards a zero press force, a setting force for a longitudinal deformation of the at least one press heating plate is increased accordingly. For an increase in the specific press force from a zero press force towards a maximum press force, the setting force for the longitudinal deformation of the press heating plates is reduced accordingly. For a reduction of the specific press force from the maximum press force towards the zero press force, the longitudinal gradient tan β is set to be approximately twice as large as the gradient tan α at the press force maximum. The longitudinal gradient and setting force can thus be controlled along an entire pressing path for an increase or decrease in the specific press force.

3 Claims, 3 Drawing Sheets

METHOD OF CONTROLLING PRESS FORCE IN A CONTINUOUSLY OPERATING PRESS

FIELD OF THE INVENTION

The invention relates to, in a continuously operating press, a method of controlling the press force on press heating plates along the press length of an operating cycle in the production of particle boards, fiberboards and similar wooden-material boards, and also of plastic sheets.

BACKGROUND OF THE INVENTION

DE-A 44 05 342 discloses a continuously operating press and a method of controlling the press force on press heating plates within the press length of an operating cycle in the production of particle boards, fiberboards and similar wooden-material boards, and also of plastic sheets. The object of DE-A 44 05 342 is to provide a continuously operating press which makes it possible, longitudinally and transversely along the pressing path between the upper and lower press heating plates, to control or adjust hydro-mechanically a change in the press nip distances both in the idling mode prior to entry of the material to be pressed (start-up mode) and also in loaded mode during production, using an on-line method in a few seconds. The solution provided has proved workable in practice.

The significant part of this solution is the elastic-non-positive suspension or connection of the upper press heating plate to the upper press ram, which can be flexibly controlled hydro-mechanically, and the elastic non-positive suspension or connection of the lower press heating plate to the lower, stationary press table, on which one or more hydraulic short-stroke plunger cylinders per press column or press frame structure are arranged transversely, centrically with respect to the convex bending deformation.

By means of this continuously operating press, the longitudinal bending deformation of the upper press heating plate in the relaxation section b+c+d of the pressing path L, particularly as required in the production of fiberboards (MDF), having steep deformation gradients (decompression angle $\beta_1$ and compression angle $\beta_2$) can be controlled hydraulically by means of mechanical actuating mechanisms on any desired press section along the pressing path L. However, the structure of these mechanical actuating mechanisms is expensive.

SUMMARY OF THE INVENTION

Accordingly, it is an object of the invention to provide a method of controlling the press force, by means of which the longitudinal deformation gradient of the upper or lower press heating plate can be increased without major economic outlay.

The above and other objects can be accomplished with a method of controlling the press force on at least one press heating plate along the press length of an operating cycle. For a reduction of specific press force from a maximum press force towards a zero press force, a setting force for a longitudinal deformation of the at least one press heating plate is increased accordingly. For an increase in the specific press force from a zero press force towards a maximum press force, the setting force for the longitudinal deformation of the press heating plates is reduced accordingly. For a reduction of the specific press force from the maximum press force towards the zero press force, the longitudinal gradient tan $\beta$ is set to be approximately twice as large as the gradient tan $\alpha$ at the maximum press force. The longitudinal gradient and setting force can thus be controlled along the entire pressing path for an increase or decrease in the specific press force.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

DETAILED DESCRIPTION OF THE PREFERRED EMBODIMENT

With the invention, by reducing press forces in the decompression section b and the compression section d of a continuously operating press, it is possible to utilize greater deformation values in the longitudinal region. With a view to the permissible overall load-bearing capacity from the sum of the bending stresses, resulting from the press forces and deformation stresses in the sections b and d (FIG. 3 and FIG. 5), a steeper, and therefore more rapid, change in the nip distance per meter can be set over the pressing path L between upper and lower press heating plates. This means, on average (i.e. in practical applications), that the change in press nip is doubled compared to the hitherto general prior art, from tan $\alpha_1$ or tan $\alpha_2$ of about 2 mm/m to tan $\beta_1$ or tan $\beta_2$ of about 4 mm/m.

The method according to the invention relates to a process control within a continuously operating press 1 (FIG. 1) for longitudinal deformation corresponding to the law sigma-total [$\sigma_{tot}$] resulting from sigma-deformation [$\sigma_v$] and sigma-bending deformation [$\sigma_{Vb}$], from the effect of specific press pressures. The invention improves over the prior art, in which a longitudinal deformation in the change in press nip between lower and upper press heating plates 33,34 of 2 mm per meter is only possible.

In practice, the law sigma-total [$\sigma_{tot}$] has not been sufficiently appreciated or has not been specifically used for process control. The gradient of the longitudinal deformability results from the permissible, material-determined load-bearing capacity of, for example, the upper press heating plate 34, when the upper heating plate 34 is deformed, by the action of the bending stress from the effective press forces and the technically desired longitudinal deformation of the upper press heating plate 34. If, for example, the press forces were increased further, it would be necessary, in order to prevent the upper press heating plate 34 from being destroyed, to minimize the deformation value. Conversely, the deformation value could be increased if the press force, i.e., the bending effect, is minimized.

Figure 3:
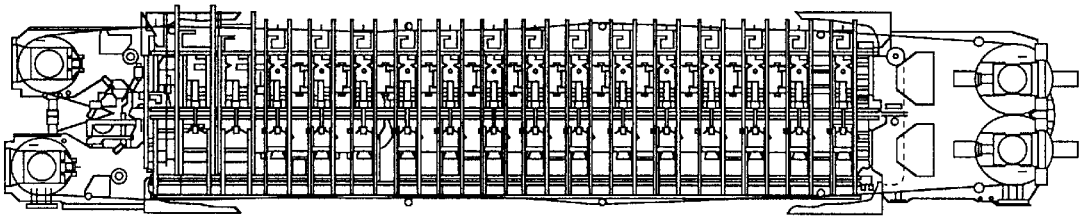
FIG. 3 is the continuously operating press in accordance with FIG. 1 on a smaller scale.
Figure 4:
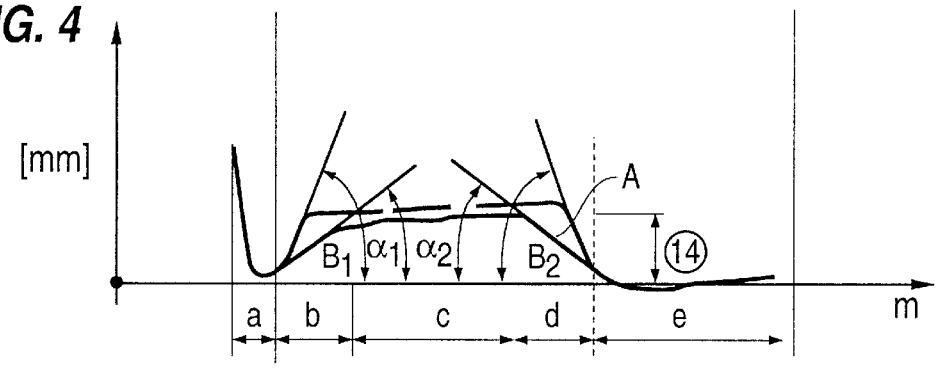
FIG. 4 is a diagram of the longitudinal deformation according to the prior art and the deformation gradient according to the invention.

For example, according to FIG. 3, in the production of fiberboards, an increase in the press nip is to be controlled for the relaxation section c. In this case, in addition to the change in press nip in accordance with FIG. 4 with the press nip 14 becoming larger, there is produced a change in press force in accordance with FIG. 5 from a maximum press force towards a zero press force. This means that, as the press force, which is adjusted accordingly by means of the actuators, decreases, a greater deformation gradient can be set from actuator to actuator, that is to say from one press column 22 to another press column 22.

Figure 5:
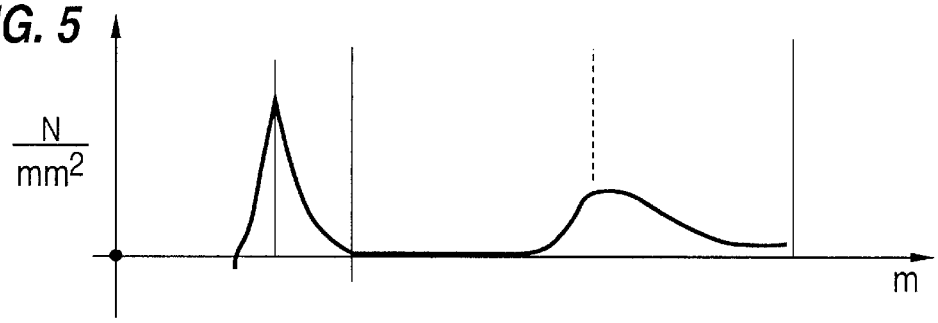
FIG. 5 is a press force profile curve corresponding to a displacement curve A in accordance with FIG. 4.

In other words, within the permissible deformation values, the press nip distance between lower and upper press heating plates 33,34 can advantageously be set more rapidly in accordance with FIG. 5 and to produce a steeper deformation gradient tan $\beta_1$ and tan $\beta_2$.

Figure 1:
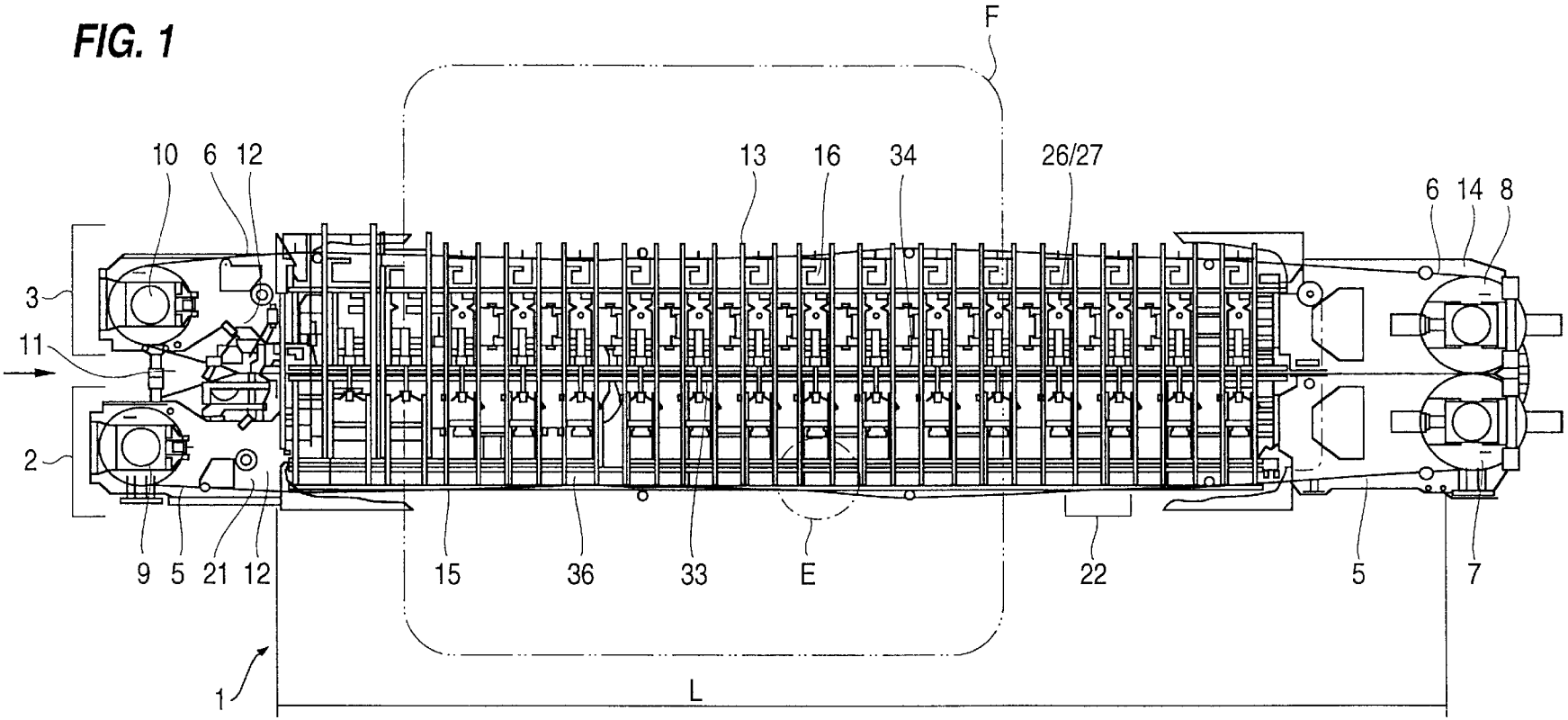
FIG. 1 is a side view of a continuously operating press for carrying out the method according to the invention.
Figure 2:
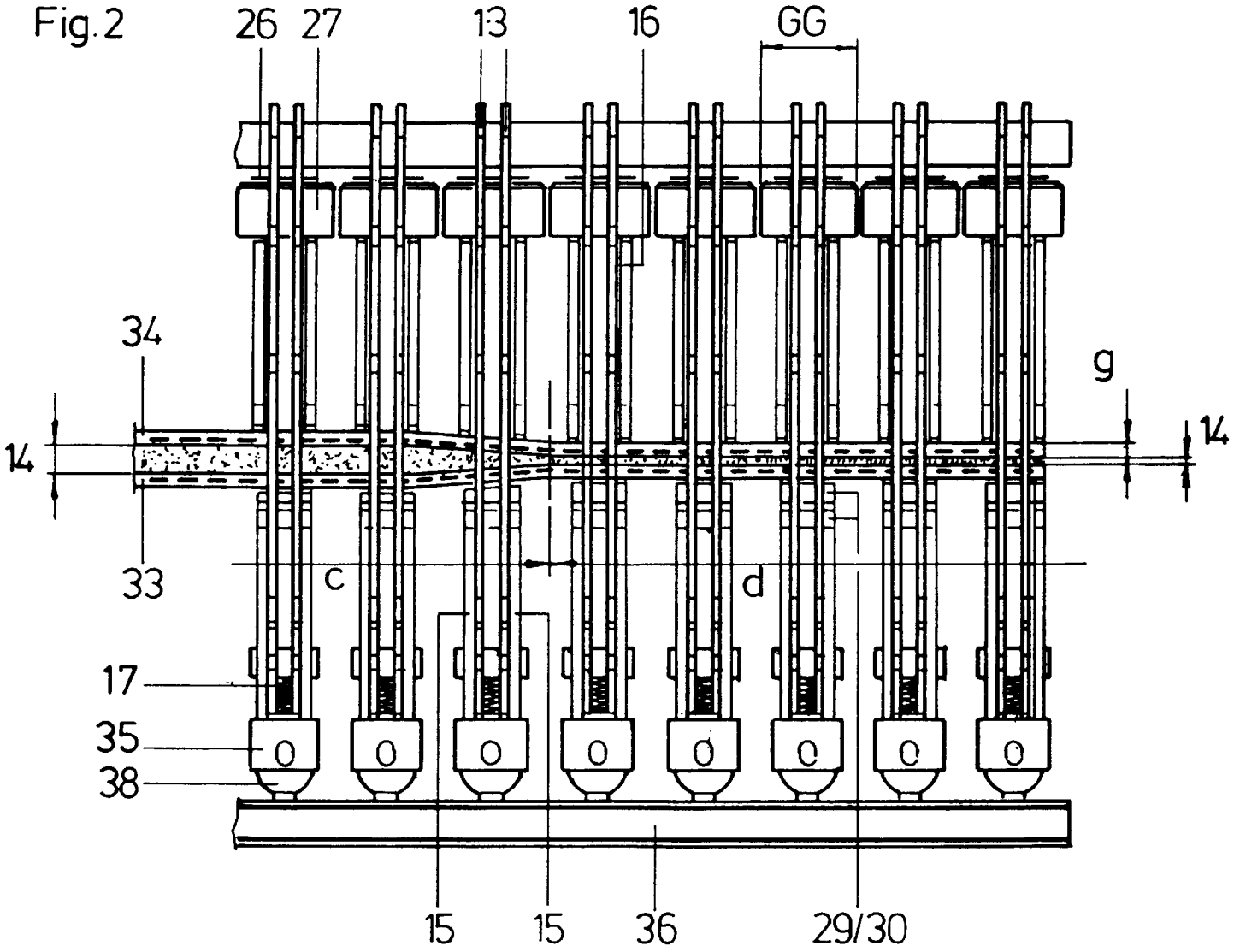
FIG. 2 shows area F from FIG. 1 in detail.

In accordance with FIGS. 1 and 2, the continuously operating press 1 for the method according to the invention comprises, as its main components, the press table 2 and the vertically movable press ram 3 which acts to set the press nip, and the tensioning brackets 13 connecting them in a positively locking manner. Entry crossbeams 21 are arranged at the end sides of press table 2 and press ram 3, and serve as anchoring and bearing locations for the drive rollers 7,8 and the deflecting rollers 9,10. The shoulders or protrusions projecting from the web plates 16 to the left and right act as abutments for raising and lowering the press ram 3. The press cylinder-piston arrangements 26,27 are arranged in openings 25 in the tensioning brackets 13.

It can further be seen from FIG. 1 how the deflecting rollers 9,10 form an entry nip 11 and how roll bars 12, which are guided with the steel bands 5,6 around press table 2 and press ram 3, are supported against the press heating plates 33, 34. That is to say, the revolving roll bars 12, as an example of a rolling support, are arranged between the press heating plates 33,34 and the steel bands 5,6 so as to roll along with them. Material 4 is drawn in through the press nip 14 together with the steel bands 5,6 driven by the drive rollers 7,8, and is pressed into boards.

Hydraulic short-stroke cylinders 29 are arranged together with short-stroke pistons 30 beneath the press heating plate 33 and are supported on support plates of lower web plates 15.

Figure 6:
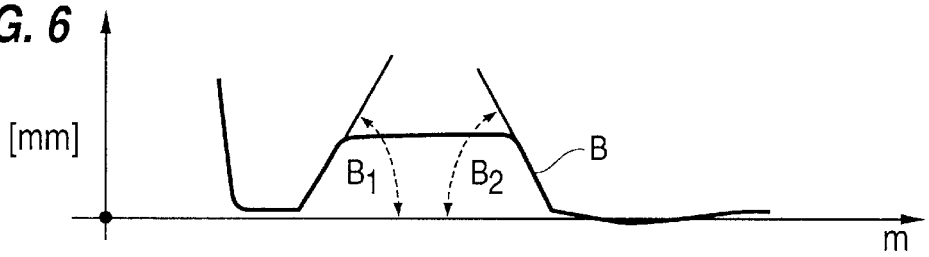
FIG. 6 is a displacement curve B having a steeper deformation gradient according to the invention with the same length of the relaxation section c.
Figure 7:
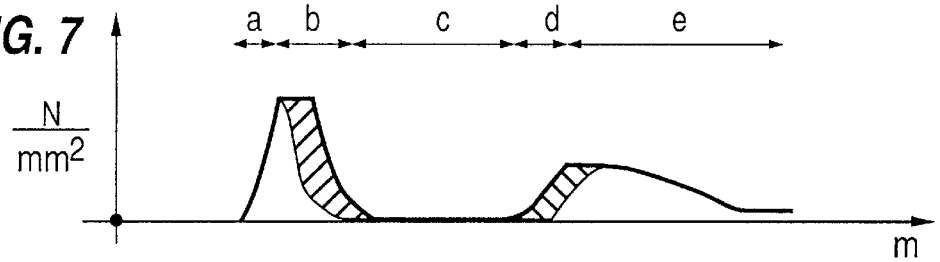
FIG. 7 is a press force profile curve, corresponding to the displacement curve B of FIG. 6, with a greater utilizable action of press force and thermal energy along the available pressing path.
Figure 1:
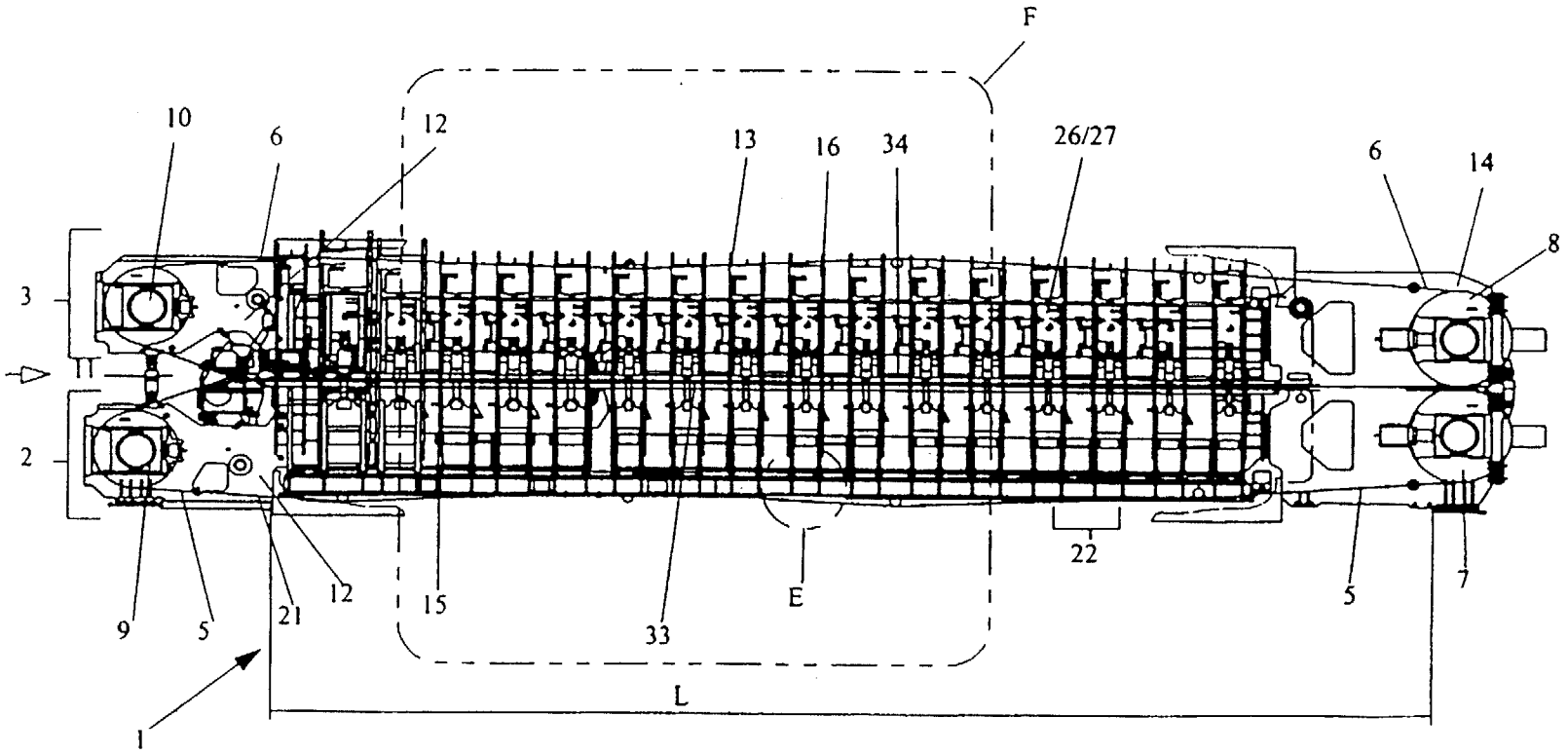
Figure 2:
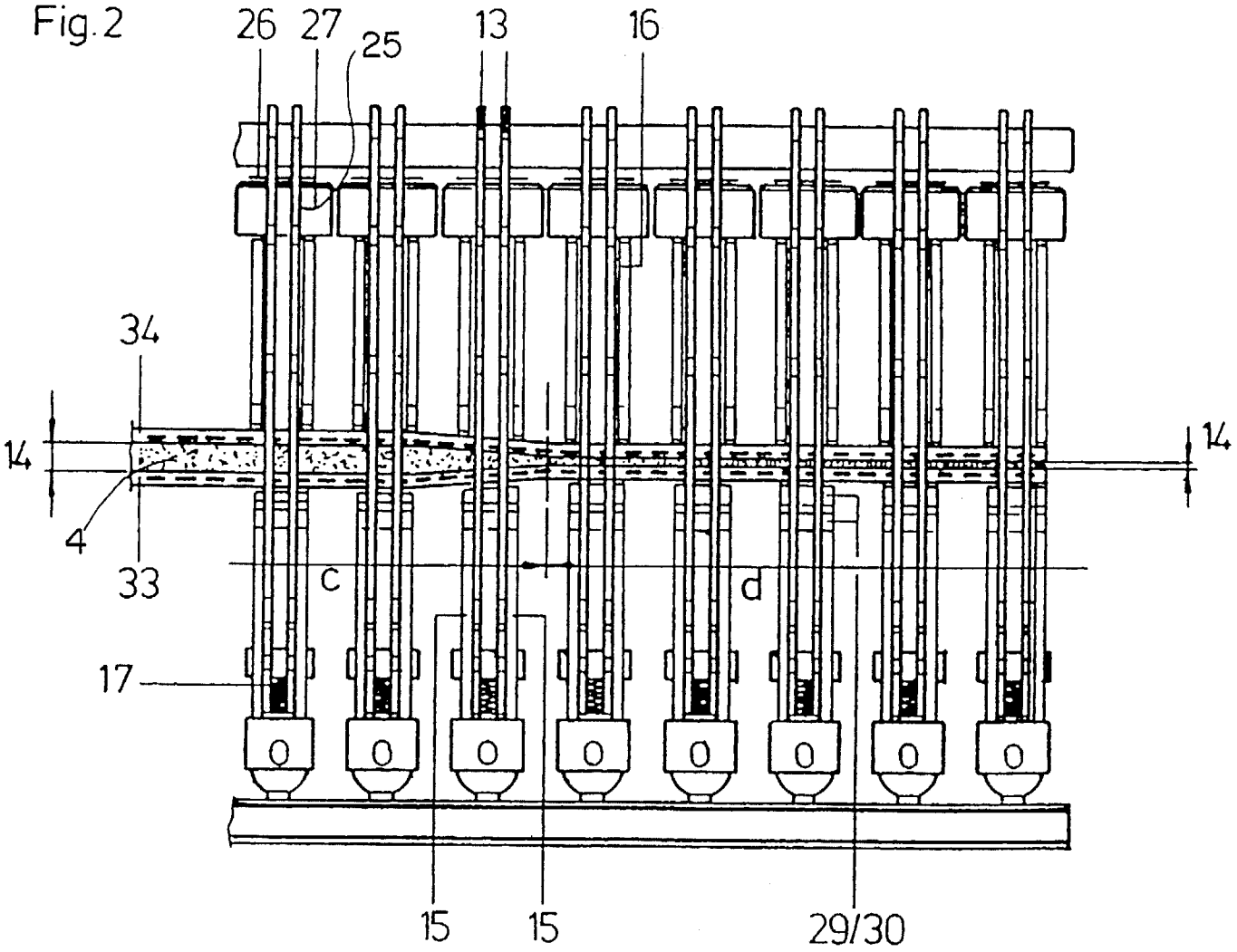

The longitudinal deformation gradients of the upper or lower press heating plates 33,34 (see FIG. 6) are increased (i.e. approximately doubled) in the decompression section b and in the compression section d. The method according to the invention is particularly beneficial for the production of ultra lightweight boards with an optimum apparent density profile, because of the highly compacted top layers, and accordingly leads to a reduction in the pressing factor (by about 10%). This is due, in accordance with FIG. 6 (see integral areas), to an increased press length being available in sections d and e, where thermal energy under pressure is supplied. As a result, a greater production output can be achieved.

The decompression section b and compression section d can be controlled optimally on-line in accordance with the thickness and/or the density of the material to be pressed 4 as a function of the speed of the steel bands 5,6 along the pressing path L. That is to say, the method according to the invention provides a significant economic advantage without having to employ additional mechanical expenditure.

It is furthermore advantageous according to the invention that, in the event of a reduction of the specific press force from its maximum to zero, or vice versa, the longitudinal gradient tan $\beta$ can be set to be approximately twice as large as the gradient tan $\alpha$ at the maximum press force. Such a setting can be controlled as desired along the entire pressing path L.

Other embodiments of the invention will be apparent to those skilled in the art from consideration of the specification disclosed herein. It is intended that the specification be considered as exemplary only, with the true scope and spirit of the invention being indicated by the following claims.

The contents of German patent application DE 196 22 197.8 filed Jun. 3, 1996 are hereby incorporated by reference.

What is claimed is:

1. A method of controlling press force on at least one press heating plate along a press length of a continuously operating press comprising the steps of:

increasing a setting force for a longitudinal deformation of the at least one press heating plate to reduce a specific press force from a maximum press force towards a zero press force; and reducing a setting force for the longitudinal deformation of the at least one press heating plate to increase a specific press force from a zero press force towards a maximum press force.

2. The method for controlling the press force as claimed in claim 1, wherein to reduce the specific press force from the maximum press force towards a zero press force, a longitudinal gradient tan $\beta$ is set to be approximately twice as large as the gradient tan $\alpha$ at the maximum press force.

3. The method for controlling the press force as claimed in claim 2, wherein the longitudinal gradient and setting force can be controlled along an entire pressing path for an associated increase or decrease in the specific press force.

* * * * *

UNITED STATES PATENT AND TRADEMARK OFFICE

CERTIFICATE OF CORRECTION

PATENT NO. : 5,875,708

DATED : March 2, 1999

INVENTOR(S) : Friedrich B. Bielfeldt

It is certified that error appears in the above-identified patent and that said Letters Patent is hereby corrected as shown below:

Column 1, line 11, delete "also of".

Column 1, line 18, delete "also of".

Column 1, line 26, after "method" insert --. The change in press nip distance takes place--.

Column 2, line 45, after "i.e." insert --,--.

Column 2, line 55, after "nip" insert --of only 2mm per meter--.

Column 2, lines 56 and 57, delete " of 2mm per meter is only" and insert --is--.

Column 3, line 12, delete "means of".

Column 3, line 51, after "i.e." insert --,--.

UNITED STATES PATENT AND TRADEMARK OFFICE

CERTIFICATE OF CORRECTION

PATENT NO. : 5,875,708

DATED : March 2, 1999

INVENTOR(S) : Friedrich B. Bielfeldt

It is certified that error appears in the above-identified patent and that said Letters Patent is hereby corrected as shown below:

Delete Drawing Sheets 1 and 2, and substitute therefore the Drawing Sheets, consisting of FIGS. 1 and 2, as shown on the attached pages.

Signed and Sealed this

Thirteenth Day of July, 1999

*Attest:*

*Attesting Officer*

Q. TODD DICKINSON

*Acting Commissioner of Patents and Trademarks*